United States Patent [19]

Achia et al.

[11] Patent Number: 4,594,142

[45] Date of Patent: Jun. 10, 1986

[54] DEWAXING WAXY HYDROCARBON OILS USING DI-ALKYL FUMARATE-VINYL LAURATE COPOLYMER DEWAXING AIDS

[75] Inventors: Biddanda U. Achia; Abraham R. DeKraker, both of Sarnia, Canada; Albert Rossi, Warren, N.J.

[73] Assignee: Exxon Research and Engineering Co., Florham Park, N.J.

[21] Appl. No.: 727,021

[22] Filed: Apr. 25, 1985

[51] Int. Cl.[4] ..... C10G 73/04

[52] U.S. Cl. ..... 208/33; 208/31

[58] Field of Search ..... 208/33, 31

[56] References Cited

U.S. PATENT DOCUMENTS

| | | | |
|---|---|---|---|
| 3,239,445 | 3/1966 | Leonard et al. | 208/33 |
| 3,413,103 | 11/1966 | Young et al. | 44/62 |
| 3,458,430 | 7/1969 | Henselman et al. | 208/33 |
| 3,475,321 | 10/1969 | Henselman et al. | 208/33 |
| 3,507,908 | 4/1970 | Young et al. | 260/485 |
| 3,729,296 | 4/1973 | Miller | 208/33 |
| 3,806,442 | 4/1974 | Reid et al. | 208/33 |
| 3,854,893 | 12/1974 | Rossi et al. | 44/62 |
| 3,981,850 | 9/1976 | Wisotsky et al. | 208/33 |
| 4,088,589 | 5/1978 | Rossi et al. | 252/56 |
| 4,191,631 | 3/1980 | Grisham, Jr. | 208/33 |
| 4,339,619 | 7/1982 | Onodera et al. | 208/33 |
| 4,377,467 | 3/1983 | Achia | 208/33 |
| 4,406,771 | 9/1983 | Briens et al. | 208/33 |
| 4,439,308 | 3/1984 | Gudelis et al. | 208/33 |
| 4,451,353 | 5/1984 | Briens et al. | 208/33 |
| 4,460,453 | 7/1984 | Gudelis et al. | 208/33 |
| 4,461,698 | 7/1984 | Briens et al. | 208/33 |

FOREIGN PATENT DOCUMENTS

| | | |
|---|---|---|
| 1248201 | 8/1967 | Fed. Rep. of Germany . |
| 1248203 | 8/1967 | Fed. Rep. of Germany . |
| 930968 | 7/1963 | United Kingdom . |
| 1151385 | 5/1969 | United Kingdom . |

*Primary Examiner*—Andrew H. Metz
*Assistant Examiner*—Glenn A. Caldarola
*Attorney, Agent, or Firm*—Joseph J. Allocca

[57] ABSTRACT

A solvent dewaxing process is described comprising mixing a waxy hydrocarbon oil, preferably a waxy petroleum oil, most preferably a waxy lube or specialties oil, with dewaxing solvent and a dewaxing aid comprising (A) a dialkylfumarate-vinyl laurate copolymer and (B) a wax-naphthalene condensation copolymer, a dialkyl fumarate-vinyl acetate copolymer or an ethylene vinyl acetate copolymer and chilling the mixture to yield a slurry comprising solid particles of precipitated wax and a solution of dewaxed oil and solvent and separating said solid wax from dewaxed oil solution.

4 Claims, No Drawings

DEWAXING WAXY HYDROCARBON OILS USING DI-ALKYL FUMARATE-VINYL LAURATE COPOLYMER DEWAXING AIDS

BRIEF DESCRIPTION OF THE INVENTION

Waxy hydrocarbon oils, preferably waxy petroleum oils, most preferably waxy lubricating oils, specialties oils, are dewaxed using a solvent dewaxing process which employs a dewaxing aid. The waxy oil to be dewaxed is mixed with the solvent, for example, propane, propylene, methyl ethyl ketone/methylisobutyl ketone, and the dewaxing aid comprising (a) polydialkyl fumarate-vinyl laurate copolymer and (b) a second component selected from the group of a condensation copolymer of wax and naphthalene, polyalkylfumarate-vinyl acetate copolymers such as dibehenyl fumarate-vinyl acetate copolymer or ethylene-vinyl acetate copolymer.

BACKGROUND OF THE INVENTION

Waxes in wax-containing hydrocarbons oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals, thereby forming a slurry comprising solid wax particles and a solution of dewaxed oil containing dewaxing solvent. The slurry is then fed to a wax separator (e.g., filter) wherein the wax is removed from the homogeneous solution of dewaxed oil and dewaxing solvent. Solvent dewaxing processes are used for heavier oil fractions such as lubricating oil distillates and Bright Stocks. Typical dewaxing solvents include low boiling point, normally gaseous, autorefrigerative hydrocarbons such as propane, propylene, butane, pentane, etc., ketones such as acetone, methylethyl ketone (MEK), methylisobutyl ketone (MIBK) and mixtures thereof, aromatic hydrocarbons such as benzene, toluene and xylene, as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration (i.e., separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and structure of the precipitated waxy crystals, the amount of oil occluded in the wax crystal and the condition and quantity of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is a Bright Stock, the waxy crystals are of an extremely fine size and not all are separated by filtration, but some leave the filter with the dewaxed oil component which creates an objectionable haze in the oil.

One way of improving the filtration rate and minimizing haze formation is to add a dewaxing aid to the waxy oil during the dewaxing process. The aid may be either mixed with the waxy oil prior to chilling, or introduced during the chilling process employing either indirect chilling means, such as scraped surface chillers, or alternatively, direct chilling means employing cold solvent. Preferred direct chilling means employing cold solvent injected along a number of stages therein, a number of which stages are highly agitated during instantaneous mixing, is DILCHILL® dewaxing (registered service mark of Exxon Research and Engineering Company) a process as presented in U.S. Pat. No. 3,773,650, hereby incorporated by reference. Other preferred direct chilling means is the autorefrigerative chilling process employing liquified normally gaseous hydrocarbons like propane as solvent.

SUMMARY OF THE INVENTION

Waxy hydrocarbon oils, preferably waxy petroleum oils, most preferably waxy lubricating oils and specialties oils, are dewaxed using a solvent dewaxing process which employs a dewaxing aid. The waxy oil to be dewaxed is mixed with, for example, propane, propylene, methyl ethyl ketone/methyl isobutyl ketone and the dewaxing aid comprising (A) polydialkyl fumarate-vinyl laurate copolymer and (B) a second component selected from the group of a condensation copolymer of wax and naphthalene, poly alkyl (meth-) acrylates, polydialkylfumarate-vinylacetate copolymers, such as behenyl fumarate-vinyl acetate copolymers or ethylene-vinyl acetate copolymers.

The mixture is chilled employing some typical direct or indirect chilling procedure to precipitate the wax and produce a wax in oil/solvent slurry which is then passed to liquid-solid separation means (e.g., centrifuge or filter) to separate the wax and recover a dewaxed oil. Solvent is separated from the oil by distillation, membrane separation or other appropriate separation procedure.

The dewaxing aid component (A) is a dialkylfumarate vinyl laurate copolymer. Table 1 shows the typical structure of fumarate vinyl ester copolymers. This component possesses a number average molecular weight (as determined by Gel Permeation Chromatography) of about 10,000 or more, preferably about 20,000 or more, most preferably about 30,000 or more. The alkyl moiety of the dialkyl fumarate monomer are the same or different alkyl groups and possess from 8 to 30 carbon atoms, excluding branching, with a preponderance of the alkyl moiety being under 18 carbon atoms in length. Preferably the alkyl moiety contains from about 12 to 16 carbon atoms excluding branching. The alkyl groups should be substantially normal, but some branching will not adversely affect the system. The dialkyl fumarate-vinyl laurate copolymer may be prepared employing a method similar to that disclosed in U.S. Pat. No. 3,729,296 for the production of polyalkyl fumarate vinyl acetate copolymers.

The dialkyl fumarate-vinyl laurate copolymer is employed in combination with a second component (B) as previously described above.

Wax-naphthalene condensation products employed as component (B) are a typical Freidel Crafts condensation product prepared in accordance with the procedures outlined in U.S. Pat. Nos. 3,458,430 or 3,910,776; polydialkyl fumarate-vinyl acetate copolymers employed as component (B) can be prepared in accordance with the procedures outlined in U.S. Pat. No. 3,729,296 while the polyalkyl(meth-) acrylates are commercially available as for example ACRYLOID (from Rohm & Haas) or SHELLSWIM (from Shell Chemical Company).

The ratio of components A/B may range from 100/1 to 1/100, preferably 1/1, most preferably 2/1.

The dewaxing aid is employed at a dose level of from about 0.001 to 2.0 weight percent active ingredient (on feed), most preferably 0.01 to 0.10 weight percent active ingredient (on feed).

This dewaxing aid combination assists in solvent dewaxing processes wherein a waxy hydrocarbon oil is mixed with a dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (A) and (B) may be precombined one with the other for addition to the waxy oil to be dewaxed, either as such or diluted in a suitable wax-free oil to improve its flow properties. Alternatively, the components may be added separately and simultaneously or separately and sequentially at the same or separate points within the process. Even in this embodiment the individual components (A) and (B) may be employed as such or diluted in a suitable wax-free oil to improve flow properties. The wax particles which are precipitated are subsequently separated from the dewaxed oil by any number of typical liquid/solid separation processes exemplified by, but not limited to, filtration, settling, centrifugation, etc.

The waxy hydrocarbon oil which is dewaxed may be any waxy oil derived from any natural or synthetic source. Waxy hydrocarbon oils, distillates, and deasphalted oils derived from such diverse sources as Kuwait, North Sea, Arab Light, Arab Medium, Western Canadian, South Louisiana, West Texas Sour, and oils derived from tar sands, shale oil or coal oils may be dewaxed by the process of the instant invention.

Autorefrigerative solvents which may be employed are any of those normally gaseous materials which become liquid at elevated pressure and/or decreased temperature. Thus, any of the light hydrocarbon liquids in the $C_1$–$C_6$ range may be employed, including liquefied methane, ethane, propane, propylene, butane, butylene and mixtures thereof, as well as liquefied natural gas or liquefied petroleum gas (LNG or LPG, respectively). The autorefrigerative solvents of choice, however, are propane, propylene and mixtures thereof.

Typical, normally-liquid dewaxing solvents include $C_3$–$C_6$ ketones, such as acetone, methyl ethyl ketone (MEK), methylisobutyl ketone (MIBK) and mixtures thereof (e.g., MEK/MIBK); $C_6$–$C_{10}$ aromatic hydrocarbons, such as toluene, benzene and xylene and mixtures thereof; mixtures of $C_3$–$C_6$ ketones with $C_6$–$C_{10}$ aromatic hydrocarbons (e.g., MEK/toluene); ethers, such as methyl tertiary butyl ether mixed with aromatic hydrocarbons (e.g., MTBE/toluene), as well as mixtures of normally-gaseous hydrocarbon atuorefrigerants and ketones (e.g., propylene/acetone). Halogenated low molecular weight hydrocarbons, such as halogenated $C_1$–$C_4$ hydrocarbons, may also be employed as dewaxing solvents, as well as mixtures thereof (e.g., dichloromethane, dichloroethane).

DESCRIPTION OF THE PREFERRED EMBODIMENT

In an embodiment of the process of the invention, a solution of dewaxing aid comprising components (A) and (B) dissolved in an appropriate solvent such as a light heating oil or a light dewaxed mineral oil fraction is mixed into the wax-containing oil and the mixture heated to a temperature higher than the cloud point of the oil (typically about 50° C. to 120° C.). The mixture is introduced, along with the dewaxing solvent, into a chilling zone and chilled to a temperature necessary to yield the desired pour point for the resulting dewaxed oil. The chilling produces a slurry comprising dewaxed oil and solvent, along with solid particles of wax which contain the dewaxing aid. This slurry is then sent to a filter to separate the dewaxed oil and solvent from the wax particles. The dewaxing temperature or temperature to which the slurry is chilled varies depending on the feed and conditions. In general, this temperature will range from about 0° C. to about −50° C. In the case where the dewaxing solvent comprises a mixture of a ketone and an aromatic hydrocarbon, such as methyl ethyl ketone/toluene, the dewaxing temperature will range from about −10° C. to about −30° C.

The dewaxing solvent is employed in an amount sufficient to give a dilution ratio (solvent to oil) of 10/1, preferably 5/1, most preferably about 1.5–3.0/1, depending on the pretreatment, wax content and viscosity grade of the feedstock being dewaxed, and the dewaxing conditions to which the feedstock is subjected.

EXAMPLE 1

About 600 ml. of waxy lubricating raffinate oil stock having a viscosity of 600 SUS at 100° F., obtained from a mixed crude comprised of Texas, Mexican and Arabian crude components subjected to vacuum distillation and solvent extraction, was charged into a pressure vessel along with dewaxing aid. A series of dewaxing aid component (A) that was tested as shown in Table 2 and Table 3, the component (B) in all cases being a wax-naphthalene condensation copolymer. Liquid propane was then added in the amount of 2.3 volumes per volume of waxy oil charged and the mixture heated with stirring to 70° C. to form a homogeneous solution. The mixture was then prechilled at a chilling rate of 6°–8° C./min. to 16° C. by means of eternal jacket chilling. Intimate mixing was provided by a 7.5 cm dia 6-blade disc turbine rotating at blade tip speed of 500 cm/s.

When a temperature of 16° C. was reached, the mixture was allowed to cool further to a final temperature of −34° C. by autorefrigeration caused by the evaporation of propane solvent from the mixture. A chilling rate of 3°–4° C./min. was maintained during this range of chilling with the agitator tip speed reduced to 100 cm/s. The rate of addition of liquid propane to the vessel and the rate of propane vapour vented from the vessel were maintained in such a fashion that the final composition ratio of liquid propane to waxy oil feed (the cold dilution ratio) of 1.6 was reached.

Chilling was terminated at −34° C., following which the slurry, comprising crystallized wax and propane-dewaxed oil solution, was transferred to a pressure filter maintained at −34° C. The propane-oil solution was separated from the wax by pressurizing the filtrate through the filter cloth under a filtration differential pressure of 5 psig. The rate of filtration and the yield of dewaxed oil were measured to determine the efficiency of separation, the results shown in Table 3.

It is evident from the results shown in Table 3 that Test #16, employing the dialkyl fumarate-vinyl laurate copolymer dewaxing aid of the subject invention, in a 1/1 mixture with component (B) dewaxing aid, gave the highest rate of separation and a very satisfactory yield of dewaxed oil. Further, it is demonstrated that:

(i) The laurate moiety of the ester group is more potent than either the acetate moiety or stearate moiety of the ester group. (Tests number 14 to 17 versus tests number 5 to 10 and test number 12).

(ii) The dialkyl moiety is preferred over the tallow moiety in the fumarate group as evidenced by test 11 over 9 for dewaxing aid of similar molecular weights.

(iii) The dialkyl fumarate-vinyl laurate copolymer is more potent than a currently known commercial polyalkylmethacrylate like ACRYLOID-150 dewaxing aid.

EXAMPLE 2

Dewaxing tests were conducted in a manner identical to that described in Example 1, but employing a deasphalted and solvent extracted waxy oil feed having a viscosity of 2,500 SUS at 100° F. A cold dilution ratio of 2.0 volumes of propane per volume of waxy feed was maintained to compensate for the higher viscosity of this stock compared to the stock used in Example 1. The results of these tests are shown on Table 3. Test number 4 of Table 3 indicates again the positive interaction of the dewaxing aid component (A) of the said invention with the component (B) to produce improved filterability over other dewaxing aids tested (Test numbers 1, 2, 5 and 6).

TABLE 1

CHEMICAL STRUCTURE OF FUMARATE/VINYL ESTER DEWAXING AIDS

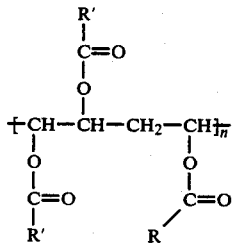

Dialkyl Fumarate or Tallow Fumarate } { Vinyl Acetate, Laurate or Stearate

Carbon Number Distribution

| Fumarate Monomer | R' | Ester Monomer | R |
|---|---|---|---|
| Dialkyl Fumarate | $C_8$ 10% | Vinyl Acetate | $C_1$ 100% |
| | $C_{10}$ 8% | | |
| | $C_{12}$ 45% | Vinyl Laurate | $C_{12}$ 100% |
| | $C_{14}$ 18% | | |
| | $C_{16}$ 9% | Vinyl Stearate | $C_{18}$ 100% |
| | $C_{18}$ 10% | | |
| Tallow Fumarate | $C_{16}$ 33% | | |
| | $C_{18}$ 67% | | |

TABLE 2

MOLECULAR WEIGHTS AND SPECIFIC VISCOSITIES OF EXPERIMENTAL FUMARATE/VINYL ESTER DEWAXING AIDS

| Copolymer of | Specific Viscosity* | Mw × $10^{-3}$ (by GPC) | Mn × $10^{-3}$ (by GPC) |
|---|---|---|---|
| Dialkyl Fumarate - Vinyl Laurate (DFVL) | 0.39 | 82 | 19 |
| Dialkyl Fumarate - Vinyl Stearate (DFVS) | 0.34 | 96 | 17 |
| Tallow Fumarate - Vinyl Laurate (TFVL) | 0.22 | 38 | 12 |
| Dialkyl Fumarate - Vinyl Laurate (DFVL) | 1.17 | 352 | 28 |
| Tallow Fumarate - Vinyl Stearate (TFVS) | 0.67 | 182 | 18 |
| Tallow Fumarate - Vinyl Laurate (TFVL) | 0.57 | 111 | 17 |

*Specific Viscosity of 2 weight percent solution of additive in Xylene at 100° F.

TABLE 3

COMPARISON OF DEWAXING AID PERFORMANCE PROPANE DEWAXING OF 600 NEUTRAL WITH DIALKYL FUMARATE-VINYL LAURATE COPOLYMER/WAX NAPHTHALENE CONDENSATION COPOLYMER COMBINATION

| Test Number | Aid Component (A) | Component (A) Weight Average Molecular Weight (× $10^3$) | Component (A) Dosage (Wt. % on Feed) Active Ingredient | Component (B) Condensation Copolymer (Wt. % on Feed) Active Ingredient | Total Aid Dosage | Ratio A/B | Feed Filter Rate ($m^3/m^2$ day) | DWO Yield (Wt. % on Feed) |
|---|---|---|---|---|---|---|---|---|
| 1 | Polyalkylmethacrylate (Acryloid 150) | 425 | 0.081 | 0 | 0.081 | — | 27.5 | 65.4 |
| 2 | | ↓ | 0.067 | 0.033 | 0.10 | 2/1 | 46.6 | 72.0 |
| 3 | | ↓ | 0.054 | 0.015 | 0.064 | 3/1 | 47.5 | 69.4 |
| 4 | | ↓ | 0.022 | 0.033 | 0.055 | 1/1 | 31.7 | 72.4 |
| 5 | Dialkylfumarate-Vinyl Acetate | 261 | 0.040 | 0.012 | 0.052 | 3/1 | 31.4 | 67.8 |
| 6 | | ↓ | 0.054 | 0.015 | 0.069 | 3/1 | 38.1 | 69.7 |
| 7 | | ↓ | 0.081 | 0.015 | 0.096 | 5/1 | 37.2 | 65.6 |
| 8 | | ↓ | 0.122 | 0.015 | 0.137 | 8/1 | 31.6 | 66.8 |
| 9 | | ↓ | 0.027 | 0.033 | 0.060 | 1/1 | 25.0 | 73.7 |
| 10 | | | 0.054 | 0.030 | 0.084 | 1/1 | 25.6 | 66.8 |
| 11 | DF-VL (laurate) | 82 | 0.067 | 0.033 | 0.100 | 2/1 | 14.6 | 64.4 |
| 12 | DF-VS (stearate) | 96 | 0.67 | ↓ | 0.100 | 2/1 | 4.4 | 63.5 |
| 13 | TF-VL | 38 | 0.067 | ↓ | 0.100 | 3.1 | 12.1 | 71.5 |

TABLE 3-continued

COMPARISON OF DEWAXING AID PERFORMANCE
PROPANE DEWAXING OF 600 NEUTRAL WITH
DIALKYL FUMARATE-VINYL LAURATE COPOLYMER/WAX NAPHTHALENE
CONDENSATION COPOLYMER COMBINATION

| Test Number | Aid Component (A) | Component (A) Weight Average Molecular Weight ($\times 10^3$) | Component (A) Dosage (Wt. % on Feed) Active Ingredient | Component (B) Condensation Copolymer (Wt. % on Feed) Active Ingredient | Total Aid Dosage | Ratio A/B | Feed Filter Rate ($m^3/m^2$ day) | DWO Yield (Wt. % on Feed) |
|---|---|---|---|---|---|---|---|---|
| 14 | DF-VL | 352 | 0.067 | ↓ | 0.100 | 2/1 | 37.9 | 66.4 |
| 15 | DF-VL | 352 | 0.048 | ↓ | 0.081 | 1.5/1 | 51.4 | 67.1 |
| 16 | DF-VL | 352 | 0.040 | ↓ | 0.073 | 1/1 | 58.2 | 69.2 |
| 17 | DF-VL | 352 | 0.029 | ↓ | 0.062 | 1/1 | 36.1 | 70.2 |
| 18 | TFVS | 182 | 0.067 | ↓ | 0.100 | 2/1 | 4.6 | 63.3 |
| 19 | TFVL | 111 | 0.067 | | 0.100 | 2/1 | 9.4 | 69.5 |

Nomenclature: DF = Dialkyl Fumarate; TF = Tallow Fumarate; V = Vinyl; A = Acetate; L = Laurate; S = Stearate

TABLE 4

FILTRATION PERFORMANCE WITH EXPERIMENTAL FUMARATE/VINYL/
ESTER DEWAXING AIDS IN PROPANE DEWAXING OF BRIGHT STOCK
Dilution Ratio = 2.0 v/v $C_3$/Feed

| Test Number | Aid Component (A) Formula | Aid Component (A) Wt. % | Aid Component* (B) Wt. % a.i. | Feed Filter Rate $m^3/m^2$ d | Dewaxed Oil Yield Wt. % |
|---|---|---|---|---|---|
| 1 | TFVL | .080 | 0.03 | 5.3 | 71.6 |
| 2 | TFVS | .080 | 0.03 | 6.6 | 67.4 |
| 3 | DFVL | .080 | 0.0 | 6.6 | 64.4 |
| 4 | DFVL | .080 | 0.03 | 13.8 | 68.1 |
| 5 | Acryloid-150 | .080 | 0.0 | 11.4 | 67.6 |
| 6 | Acryloid-150 | .071 | 0.03 | 10.8 | 68.4 |

*Aid component (B) = Wax-Naphthalene Condensate Copolymer; Paraflow-149

What is claimed is:

1. A method for dewaxing waxy hydrocarbon oils comprising mixing the waxy hydrocarbon oil feedstock with a dewaxing solvent and a dewaxing aid, said dewaxing aid comprising (A) a dialkyl fumarate-vinyl laurate copolymer having a number average molecular weight of about 30,000 or more, as determined by gel permeation chromatography; and (B) a second component selected from a wax-naphthalene condensation copolymer, dialkyl fumarate-vinyl acetate copolymer or an ethylene-vinyl acetate copolymer, components (A) and (B) being used in a ratio of (A) to (B) of 2/1 to 1/1, chilling the waxy hydrocarbon oil/dewaxing solvent/dewaxing aid combination to precipitate solid particles of wax therefrom, producing a slurry of wax/-dewaxed oil dewaxing solvent/dewaxing aid, and separating the wax from said slurry and recovering a dewaxed oil.

2. The method of claim 1 wherein the dialkyl moieties of the dialkyl fumarate-vinyl laurate copolymer are the same or different $C_8$ to $C_{30}$ groups, excluding branching.

3. The method of claim 2 wherein the dewaxing aid combination is used at a dose level of about 0.001 to 2.0 weight percent active ingredient, based on feed.

4. The process of claim 3 wherein the dewaxing solvent is selected from liquefied, normally gaseous $C_1$–$C_6$ autorefrigerants, $C_3$–$C_6$ ketones and mixtures thereof, $C_6$–$C_{10}$ aromatic hydrocarbons, and mixtures thereof, mixtures of $C_3$–$C_6$ ketones and $C_6$–$C_{10}$ aromatic hydrocarbons, mixtures of autorefrigerant solvents and ketones, halogenated low molecular weight hydrocarbons.

* * * * *